United States Patent [19]

Sigl

[11] Patent Number: 4,814,566

[45] Date of Patent: Mar. 21, 1989

[54] PUSH-BUTTON KEYBOARD ASSEMBLY WITH EMI AND RFI-SHIELDED MULTIPLE INDIVIDUALLY-REPLACEABLE SWITCH MODULES

[76] Inventor: Edward D. Sigl, 0700E 300N, Bluffton, Ind. 46714

[21] Appl. No.: 110,933

[22] Filed: Oct. 20, 1987

[51] Int. Cl.[4] ..... H01H 13/04

[52] U.S. Cl. ..... 200/305; 361/212

[58] Field of Search ..... 200/305, 304; 361/212, 361/220

[56] References Cited

U.S. PATENT DOCUMENTS

| | | | |
|---|---|---|---|
| 3,317,698 | 5/1967 | Mansfield | 200/305 |
| 3,487,186 | 12/1969 | Johnson et al. | 200/305 |
| 4,017,700 | 4/1977 | West | 200/159 A |
| 4,046,982 | 9/1977 | Schadow et al. | 200/159 R |
| 4,059,737 | 11/1977 | Gergaud | 200/5 A |
| 4,092,503 | 5/1978 | Raeder | 200/5 A |
| 4,096,368 | 6/1978 | Grebner | 200/314 |
| 4,195,210 | 3/1980 | Pounds et al. | 200/159 A |
| 4,288,672 | 9/1981 | Puccini | 200/314 |
| 4,303,960 | 12/1981 | Sherwood et al. | 361/212 |
| 4,359,618 | 11/1982 | Stevens | 200/314 |
| 4,365,120 | 12/1982 | Pounds | 200/5 A |
| 4,371,759 | 2/1983 | Clark, Jr. | 200/5 R |
| 4,385,213 | 5/1983 | Larson | 200/5 A |
| 4,385,218 | 5/1983 | Nishida | 200/159 B |
| 4,385,219 | 5/1983 | Finlayson | 200/159 A |
| 4,419,555 | 12/1983 | Kim | 200/314 |
| 4,439,646 | 3/1984 | Bouvrande | 200/5 A |
| 4,456,800 | 6/1984 | Holland | 200/5 A |
| 4,476,355 | 10/1984 | Mital | 200/5 A |
| 4,531,034 | 7/1985 | Inaba | 200/314 |
| 4,536,625 | 8/1985 | Bebie | 200/5 A |
| 4,540,865 | 9/1985 | Calder | 200/340 |
| 4,559,427 | 12/1985 | Dolson et al. | 200/159 B |
| 4,575,589 | 3/1986 | Hoffmann | 200/5 A |
| 4,580,018 | 4/1986 | Yoshihara | 200/5 A |
| 4,585,914 | 4/1986 | Ohashi et al. | 200/284 |
| 4,586,106 | 4/1986 | Frazier | 361/212 |
| 4,598,181 | 7/1986 | Selby | 200/5 A |
| 4,635,167 | 1/1987 | Schlosser | 362/85 |

FOREIGN PATENT DOCUMENTS

| | | | |
|---|---|---|---|
| 2069764 | 8/1981 | United Kingdom | 200/305 |

*Primary Examiner*—Renee S. Luebke

*Attorney, Agent, or Firm*—George Pappas

[57] ABSTRACT

A keyboard assembly includes a printed circuit board having conductive paths defining a plurality of switch sites. Contact terminals are connectable in electrical circuits with the conductive paths. The assembly also includes an electrically-groundable conductive panel overlying the board and having a plurality of apertures defined therein in registry with the switch site. A dielectric layer is disposed between the panel and board providing electrical isolation therebetween. A plurality of individually-replaceable EMI RFI-shielded switch modules are installed in registry with the apertures on the conductive panel, in overlying relation to the switch sites, and electrically connected to the conductive panel.

42 Claims, 5 Drawing Sheets

PUSH-BUTTON KEYBOARD ASSEMBLY WITH EMI AND RFI-SHIELDED MULTIPLE INDIVIDUALLY-REPLACEABLE SWITCH MODULES

BACKGROUND OF THE INVENTION

The present invention generally relates to keyboard assemblies and, more particularly, is concerned with a push-button type keyboard assembly having a plurality of individual switch modules removably installed at switch sites on a printed circuit board of the assembly. The modules contain resilient conductive elements and components that shield the switch sites from leakage of externally or internally originating electromagnetic interference (EMI) and radio frequency interference (RFI) past the conductive elements and into electrical circuit paths on the board that contain the switch sites. In the case of internally originating interference, the switch modules retain the interference behind the keyboard assembly.

It is conventional to provide keyboard assemblies which include switches installed on a printed circuit board and which are composed of dome-shaped resilient snap-action conductive elements that interact with contacts at the switch sites in electrical circuit paths on the board. Typically, a frame having a plurality of openings which receive push-buttons overlies the circuit board with the push-buttons in registry with the switch sites and in overlying contact with the dome-shaped conductive elements installed at the switch sites.

Application of pressure on a dome-shaped conductive element via one of the push-buttons by a user results in depression and snap action tripping of the element from a convex to concave configuration causing closing of the contacts at the switch site of the element. Then, when the pressure is removed by the user, the element springs back to its original convex configuration causing opening of the contacts. The spring return force is generated upon tripping which upon release of the depressing force causes the dome to return to its original shape to open the contacts. It is desirable to use a dome-shaped conductive switch element because when depressed and actuated it produces a tactile feedback or snap action upon being tripped that is felt by the user to indicate switch closure.

Representative of the prior art which use dome-shaped conductive switch elements are the keyboard assemblies disclosed in U.S. Pat. Nos. to Schadow et al. (4,046,982), Pounds et al., (4,195,210), Puccini (4,288,672), Pounds (4,365,120), Nishida (4,385,218), Bouvrande (4,439,646), Holland (4,456,800) and Mital (4,476,355). While many prior art keyboard assemblies would appear to operate reasonably well and generally achieve their objectives under the range of operating conditions for which they were designed, most seem to embody certain shortcomings which make them less than an optimum design. One shortcoming is that the useful life of keyboard assemblies frequently depends upon the expected life of their dome-shaped conductive elements. Many keyboard assemblies are constructed in such a way that a defective or failed dome-shaped element cannot be replaced necessitating the replacement of the entire assembly. Another shortcoming with most keyboard assemblies is that a change in the design of one part of the assembly necessitates redesign of the remainder of the parts thereof. Such redesign is extremely costly. Still another shortcoming with most prior art keyboard assemblies is the general lack of an effective way to shield electrical circuits behind the keyboard from the deleterious effects of externally-originating EMI and RFI by preventing leakage thereof past the push-buttons and dome-shaped conductive elements to the printed circuit board of the assembly or, in the case of internally originating EMI or RFI, to retain the EMI or RFI behind the keyboard so it does not escape. EMI, RFI-shielded keyboard assemblies are generally required in military applications.

Consequently, a need exists for a push-button keyboard assembly which employs means to effectively block leakage of EMI and RFI, both externally and internally originating. The keyboard assembly also should adopt a construction which allows replacement of failed components and provides standardization of components to allow their interchangeability and, without the need for complete redesign when one part of the assembly is redesigned.

SUMMARY OF THE INVENTION

The present invention provides an EMI RFI-shielded push-button keyboard assembly designed to satisfy the aforementioned needs. The present invention is incorporated in a push-button keyboard assembly of the type which includes a printed circuit board and a plurality of switches defined by a plurality of contacts at switch sites on the board and a plurality of dome-shaped resilient snap-action conductive elements installed in registry and coactable with the contacts at the switch sites. The present invention is also directed to individual switch modules removably installable at the switch sites. The modules contain the dome-shaped conductive elements and components associated therewith to shield the switch sites from leakage of externally or internally-originating EMI or RFI past the dome-shaped elements and into electrical circuits behind the keyboard or, in the case of internally-originating EMI or RFI, allowing it to escape.

The present invention thus adopts a modular approach which allows the individual switch modules to be preassembled and pre-tested. Switch modules having different depression forces can be specified and stocked while the rest of the components—the push-buttons, front plates and circuit boards—can be the same. Different circuit board designs can be specified without changing the designs of the other components. A failed or defective component can be replaced without the necessity to discard the remainder of the components of the particular assembly.

In one form thereof, the present invention relates to an electromagnetic interference and radio frequency interference-shielded switch module. The switch module includes a body having upper and lower faces and first and second contact terminals disposed in the body, each of which extend out of the upper and lower faces of the body and each of which define a respective electrical contact face on the upper face of the body and a respective connecting terminal on the lower face of the body. A flexible conductive sealing member is received over the upper face of the body and defines a cavity therebetween. A resilient conductive snap-action contact element is located in the cavity and is in contact with both of the terminal contact faces when depressed toward the body upper face. A non-conductive spacer is also located in the cavity between the sealing member and the contact element and provides electrical isolation therebetween. A conductive retaining means surrounds a portion of the body and a portion of the sealing member for holding the body and the sealing member together. The conductive retaining means is electrically in contact with the sealing member for conducting electromagnetic interference and radio frequency interference away from the sealing member.

In one form thereof, the present invention relates to an electromagnetic interference and radio frequency interference-shielded switch module including a switch site having a plurality of contact terminals and a non-conductive sealing member situated over the switch site and defining a cavity over the switch site. A resilient conductive snap-action contact element is located in the cavity and is in contact with a plurality of the terminals when depressed toward the switch site. A conductive wire mesh is situated over the sealing member. A retaining means for holding the wire mesh over the sealing member and holding both the wire mesh and the sealing member over the switch site is provided.

In one form thereof, the present invention relates to an electromagnetic interference and radio frequency interference-shielded switch module which includes a switch site having a plurality of contact terminals and a conductive sealing member situated over the switch site and defining a cavity over the switch site. A resilient conductive snap-action contact element is located in the cavity and is in contact with a plurality of the terminals when depressed towards the switch site. A spacer means is provided in the cavity between the sealing member and the contact element for providing electrical isolation therebetween. A retaining means is also provided for holding the sealing member over the switch site.

These and other advantages and attainments of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the course of the following detailed description, reference will be made to the attached drawings in which.

Corresponding reference characters indicate corresponding parts throughout the several views of the drawings.

DETAILED DESCRIPTION OF THE PREFERRED EMBODIMENTS

Figure 1:
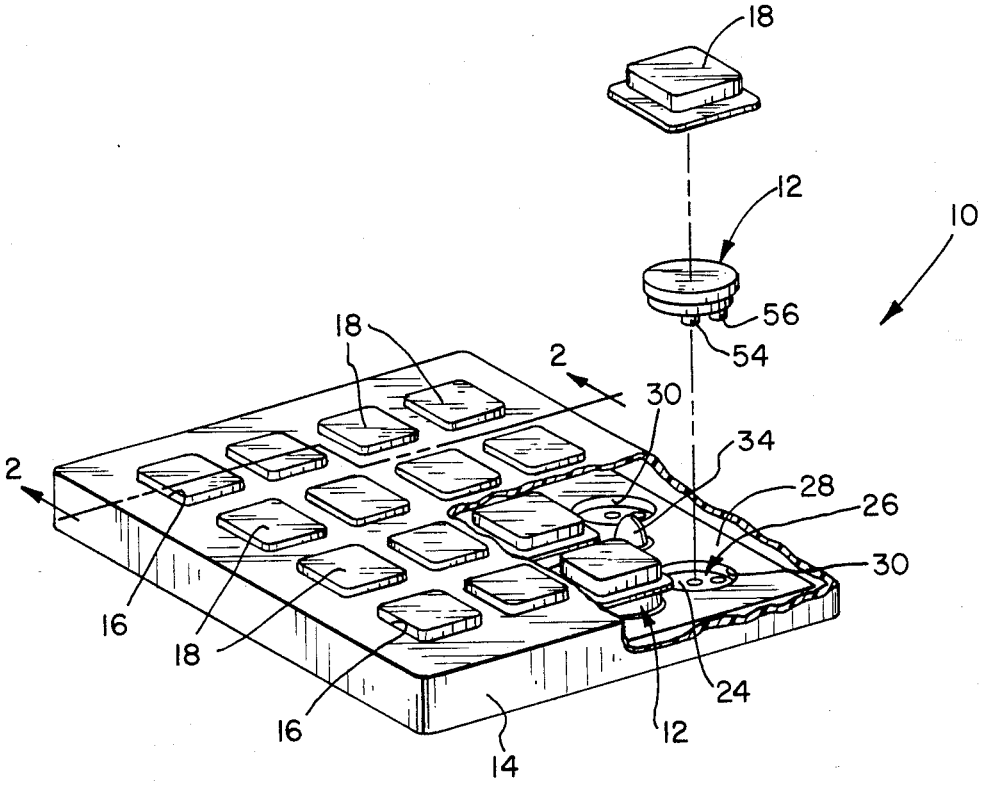
FIG. 1 is a perspective view, with some parts broken away and other parts in exploded form, of a push-button keyboard assembly employing a plurality of EMI RFI-shielded switch modules constructed in accordance with a first embodiment of the present invention.
Figure 3:
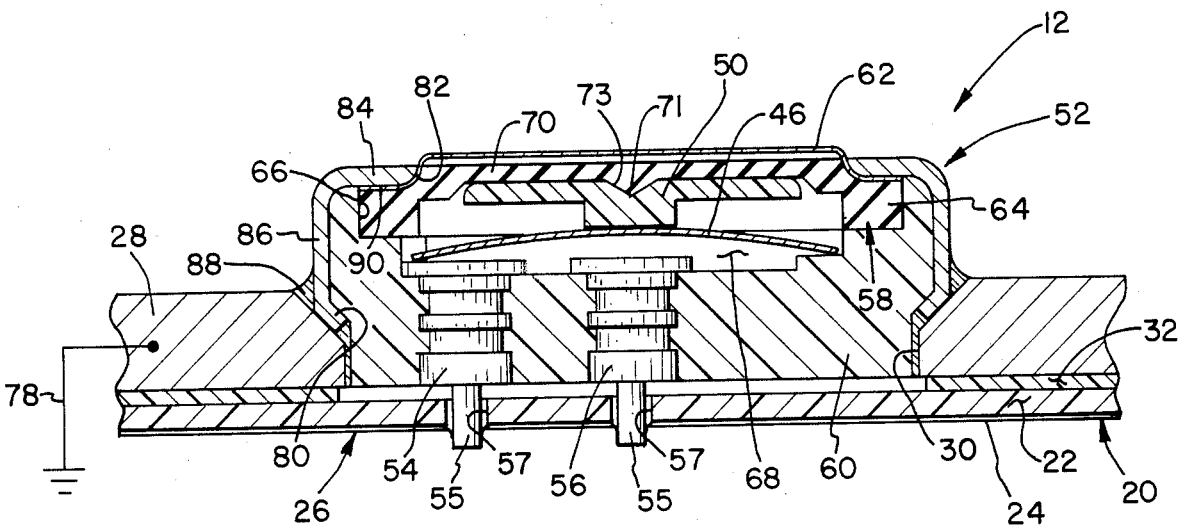
FIG. 3 is an enlarged sectional view of one of the EMI-shielded switch modules of the assembly of FIG. 2, illustrating an unlighted version of the first embodiment of the switch module.
Figure 2:
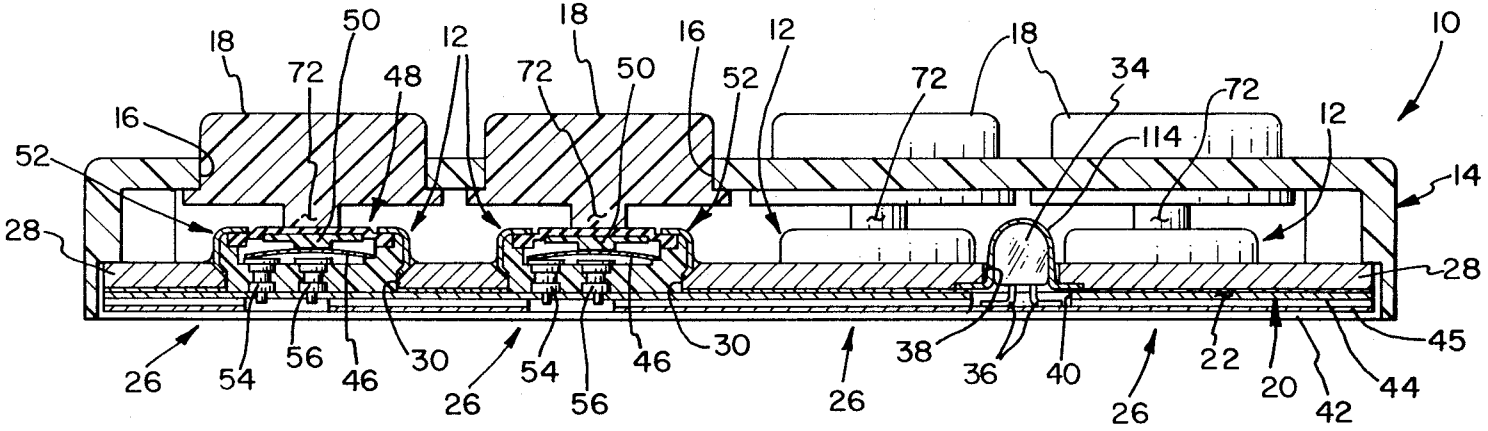
FIG. 2 is an enlarged sectional view of the keyboard assembly taken along line 2—2 of FIG. 1.

In general, the present invention relates to push-button keyboard assemblies and includes two embodiments of EMI RFI-shielded switch modules. The first embodiment is a cup-type switch module shown in FIGS. 1–9. The second embodiment is an annular ring compressed-type switch module shown in FIGS. 12–16. As summarized in the preceding brief description of the drawings, there are different versions of the two embodiments. With respect to the first embodiment, FIGS. 1–3 illustrate a first, unlighted version of the cup-type switch module, whereas FIGS. 6 and 7 relate respectively to first and second, lighted versions thereof. With respect to the second embodiment, FIGS. 12–16 illustrate first through fifth versions of the annular ring compressed-type switch module.

Referring now to the drawings, and particularly to FIGS. 1–3, there is shown an EMI RFI-shielded push-button keyboard assembly, generally designated as 10, incorporating a plurality of EMI RFI-shielded cup-type switch modules 12 representing the aforementioned first unlighted version of the first embodiment thereof. The keyboard assembly 10 includes an outer frame 14 having a plurality of key or push-button openings 16, a plurality of keys or push-buttons 18 received in the openings 16, and a printed circuit board 20. The board 20 has a substrate 22 which carries a plurality of conductive leads or paths 24 terminating at a plurality of different switch sites 26. Keyboard assembly 10 also includes an electrically-groundable conductive panel 28 overlying the printed circuit board 20 and having a plurality of apertures 30 defined therein in registry with the switch sites 26. A dielectric layer 32 is disposed between the printed circuit board 20 and electrically-groundable conductive panel 28 providing electrical isolation therebetween.

Additionally, a plurality of lamps 34 (either incandescent or a LED) are incorporated by the keyboard assembly 10 between the underside of the frame 14 and the top of the conductive panel 28. The lamps 34 are electrically connected via leads 36, extending through other aligned apertures 38 and 40 defined through the panel 28 and board 20, respectively, to a lamp circuit board 42 mounted to the rear side of the printed circuit board 20. A dielectric layer 44 is situated between board 42 and board 20. Conductive leads or paths 45 terminate near apertures 38 and 40 for connection to leads 36 of lamps 34. Push-buttons 18 are composed of translucent plastic material and, thus, light emitted from the lamps 34 is visible through the push-buttons 18.

The first, unlighted version of the first embodiment of the EMI RFI-shielded switch module 12, as seen in detail in FIGS. 2 and 3, includes a conductive contact element 46, non-conductive spacer means or spacer 50, annular-shaped conductive retaining means or cup generally designated as 52, and first and second contact terminals 54 and 56.

Figure 2A:
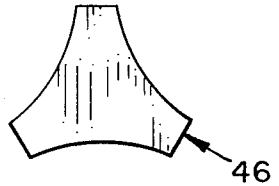
FIG. 2A is a top plan view of a dome-shaped tri-legged resilient snap-action conductive element employed by some EMI-shielded switch modules.
Figure 5:
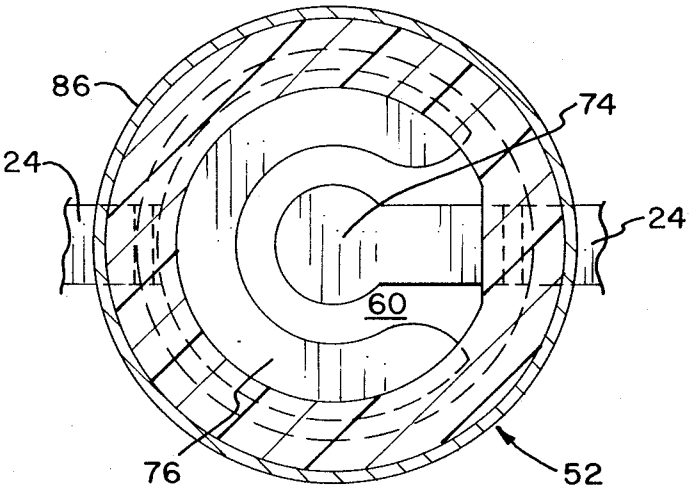
FIG. 5 is a top plan view of the set of contact terminals as seen along line 5—5 of FIG. 4.
Figure 4:
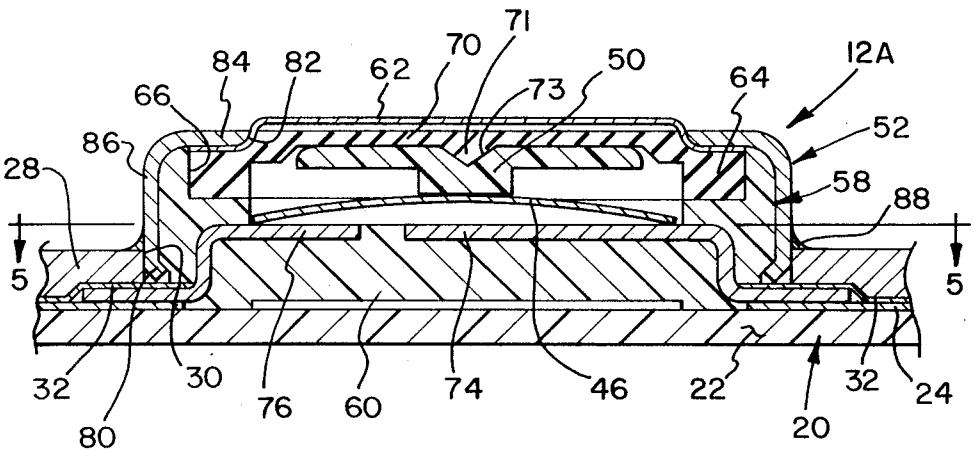
FIG. 4 is an enlarged sectional view of an EMI RFI-shielded switch module similar to that of FIG. 3, but with a set of contact terminals at the switch site that are different from those shown in FIG. 3.

Referring to FIG. 2A, the contact element 46 preferably has a dome-shaped, symmetrical tri-legged, configuration and employs a resilient snap-action motion in its actuation. Contact element 46 can also be substantially dome disk-shaped. The tri-legged contact element 46 is preferably used with the contact terminals shown in FIGS. 4, 5, 10 and 12–16 discussed hereinbelow whereas a dome disk-shaped contact element 46 can be used with all embodiments and versions described herein. Contact element 46 can be composed of any suitable conductive metallic or plastic material.

When the switch module 12 is installed in the keyboard assembly 10, the contact element 46 is disposed in registry or alignment with one of the apertures 30 in the conductive panel 28 and in overlying relation to the one switch site 26 aligned with the aperture. The lower tip portions 55 of terminals 54 and 56 are received in holes 57 of board 20 and soldered to conductive leads 24 in a known and customary fashion. The resilient dome-shaped snap-action contact element 46 is capable of actuation by application of a depressing force thereon causing its deformation from a convex to concave configuration. Actuation of the contact element 46 in such manner causes closing of the first and second contact terminals 54 and 56 disposed at the switch site 26 by forming a contacting electrical bridge between the contact terminals. Release of application of the force from the contact element 46 allows the contact element 46 to deactuate by snapping back to its original convex configuration wherein it only contacts the first contact terminal 54.

The switch module 12 also includes a flexible cap-like conductive sealing member 58, a non-conductive cylindrical-shaped filler body 60 and a circular-shaped patch of flexible conductive metallic wire mesh 62. The conductive sealing member 58 overlies the filler body 60 and underlies the wire mesh 62 and all are disposed in registry with the one aperture 30 in the conductive panel 28 and in overlying relation to the one switch site 26. The sealing member 58 can be composed of a conductive silicon rubber sealer material and the filler body 60 can be composed of any suitable non-conductive plastic or rubber material.

The cap-like sealing member 58 has an annular rim portion 64 being generally square in cross-section which seats in an annular recess 66 formed within the upper end of the filler body 60. The sealing member 58 and filler body 60 together define therebetween an interior hollow cavity 68 which is closed at its bottom by the filler body 60 and closed at its top to the exterior of the switch module 12 by a resilient flexible central portion 70 extending across and integrally connected to the annular rim portion 64 of the sealing member 58. The hollow cavity 68 contains the dome-shaped contact element 46 therein. The flexible central portion 70 of the cap-like sealing member 58 is substantially less in thickness than the annular rim portion 64 thereof and is depressible toward the contact element 46 to cause spacer means 50 to travel downwardly and further cause the above-described actuation of element 46. A depression-producing force is applied to the flexible central portion 70 via a protuberance 72 located on the bottom of each of the push-buttons 18, as seen in FIG. 2, upon depression of the push-button by a user. Further, central portion 70 includes conical protrusion 71 extending downwardly and being received by a conical recess 73 in spacer means 50 thus retaining spacer means 50 concentric to portion 70 during and after actuation.

The circular patch of flexible conductive wire mesh 62 is situated externally of the upper end of the sealing member 58, overlying and covering at least part of the annular rim portion 64 and all of the flexible central portion 70 of the sealing member 58. The wire mesh 62 and sealing member 58 provide a conductive shield that overlies the contact element 46 and the one switch site 26 and prevents leakage of externally originating and EMI and RFI past the contact element and to the switch site and circuit paths on the printed circuit board 20 or, in the case of internally-originating EMI and RFI, allowing it to escape out of the switch modules.

The non-conductive spacer means 50 of the switch module 12 is disposed in the interior hollow cavity 68 between and in contact with the dome-shaped contact element 46 and the flexible central portion 70 of the sealing member 58. The spacer means 50 can be a non-conductive plastic insulator or plunger which prevents direct contact between the conductive cap-like sealing member 58 and the dome-shaped conductive contact element 46. The spacer means 50 is also capable of transmitting to the conductive contact element 46 the depression-producing force applied to the flexible central portion 70 of the sealing member 58 for causing the above-described actuation of the contact element 46 thereby closing the contact terminals 54 and 56 at the switch site 26.

The first and second conductive contact terminals 54 and 56 of the switch module 12 are each generally cylindrical in configuration. The contact terminals 54 and 56 are mounted vertically in side-by-side, electrically-isolated, spaced relation to one another in the non-conductive filler body 60. The terminals 54 and 56 extend through the filler body 60 from the hollow cavity 68 to the exterior of the bottom side of the filler body 60. As mentioned previously, the contact element 46 contained in the hollow cavity 68 overlies the contact faces of the first and second contact terminals 54 and 56 but only makes electrical contact with the upper end or contact face of the first contact terminal 54 prior to depression and actuation of the contact element 46. The lower tip portion 55 of the first and second contact terminals 54 and 56 are soldered to the conductive paths 24 at the switch site 26 on the printed circuit board 20 as described hereinabove.

It should be noted that other types of contact terminals can be used in place of the type shown in FIGS. 2, 3, 6 and 7. Attention is directed to an alternative version of the first embodiment of the switch module, generally designated as 12A in FIGS. 4 and 5, wherein the module 12A is identical to that of FIGS. 2 and 3 except for a different type of contact terminals and filler body 60. The first and second contact terminals of switch module 12A are of the type which respectively include a flat circular pad 74 and a flat horseshoe-shaped pad 76 which partially encompasses the circular pad 74 in outwardly spaced relation thereto. Pads 74 and 76 are insert molded into filler body 60 and are further connected to conductive paths 24 of circuit board 20. A dielectric layer 32 is disposed between conductive paths 24 (board 20) and conductive panel 28 providing electrical isolation therebetween. It will be noticed in FIG. 10 that this alternative type of contact terminal is used on the circuit board of the keyboard assembly which employs the second embodiment of the switch module.

The annular-shaped conductive retaining means or cup 52 of the switch module 12 is electrically and physically connected to the conductive panel 28 and over the patch of flexible conductive wire mesh 62. Due to such interconnection with the conductive panel 28, which is electrically-grounded at 78, the conductive wire mesh 62, conductive sealing member 58, and annular-shaped conductive retaining means 52, together with the panel 28, provide an electrical path for draining EMI and RFI. The conductive retaining means 52 also surrounds and overlies the annular rim portion 64 of the cap-like sealing member 58 for holding the sealing member 58 in place and maintaining the dome-shaped contact element 46 in overlying relation with the non-conductive spacer means 50 disposed between the contact element 46 and the flexible central portion 70 of the sealing member 58.

More particularly, the conductive retaining means 5 has a generally cylindrical inverted cup-shaped configuration with an inturned lip 80 at its lower end and an opening 82 formed in the upper end defining an inturned rim 84. The lower lip 80 and upper rim 84 are interconnected with a vertical endless cylindrical sidewall 86. The retaining means sidewall 86 laterally surrounds, and is anchored via upper rim 84 and lower lip 80 to the filler body 60. Also, the lower lip 80 and a portion of sidewall 86 of the inverted cup-shaped retaining means 52 is electrically connected to the conductive panel 28 via solder or conductive adhesive 88. The retaining means upper rim 84 overlies a peripheral edge portion 90 of the patch of wire mesh 62 and makes electrical contact therewith and, also, overlies and downwardly compresses the annular rim portion 64 of the cup-shaped sealing member 58.

Figure 6:
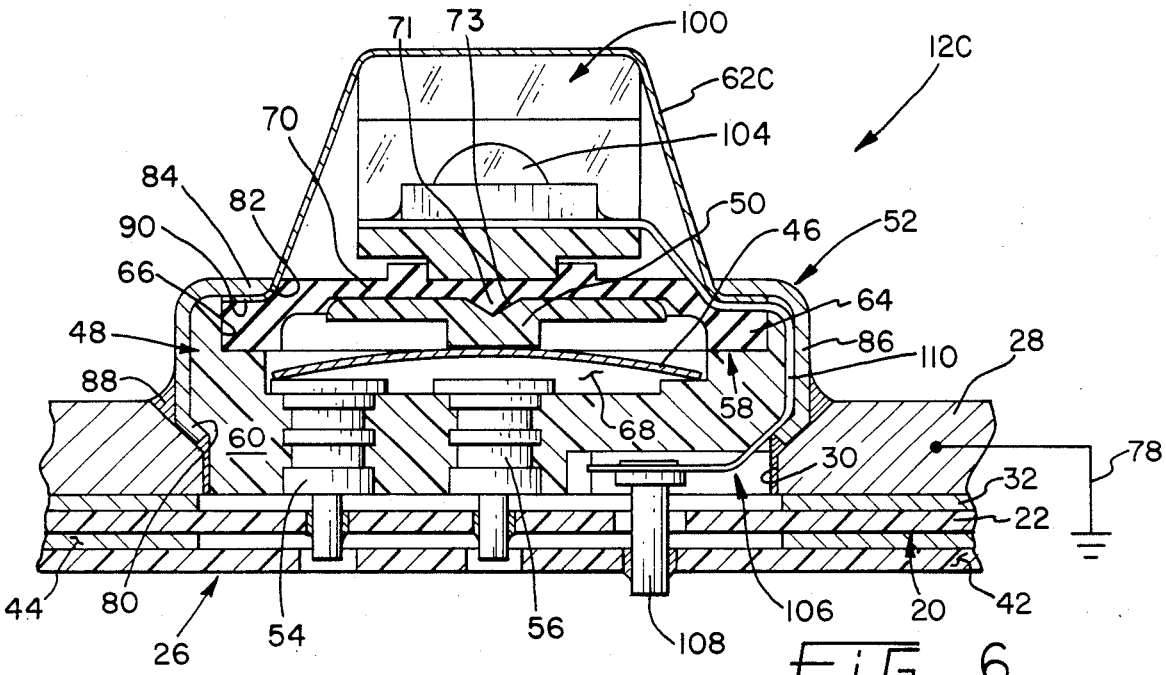
FIG. 6 is a sectional view of an EMI RFI-shielded switch module similar to that of FIG. 3, but illustrating a first lighted version of the first embodiment of the switch module.

In contrast to the first unlighted version of the switch module 12 just described above and the second lighted version of the switch module 12C of FIG. 6, the third lighted version of the switch module 12D (FIGS. 7 and 8) employs a cup-shaped conductive retaining means 52D having an upper rim 84D which underlies the peripheral edge portion 90D of the wire mesh patch 62D. In this third version, an endless flexible spring 92, such as a garter spring or "O" ring type spring, is provided in expanded form and placed about the peripheral edge portion 90D of the wire mesh patch 62D. Upper rim 84D is S-shaped in cross section and defines an annular groove for receiving spring 92 as shown. The spring 92 is thus received or attached about the wire mesh edge portion 90D on the rim 84D of the cup-shaped retaining means 52D and, optionally, conductive adhesive 94 can be used to supplement the attachment.

Figure 7:
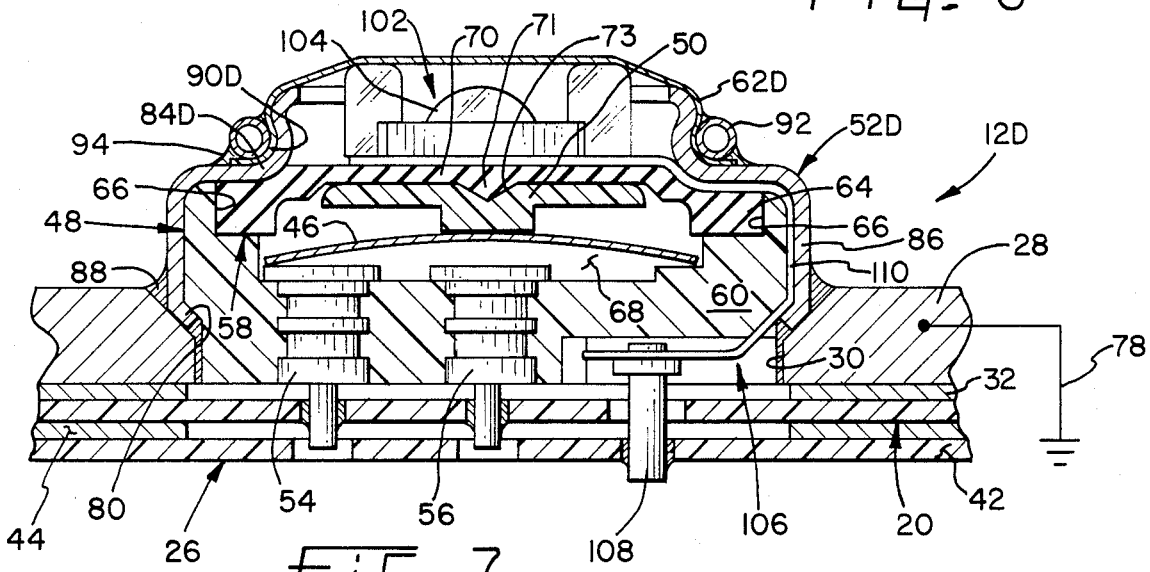
FIG. 7 is a sectional view of an EMI RFI-shielded switch module similar to that of FIG. 3, but illustrating a second lighted version of the first embodiment of the switch module.
Figure 8:
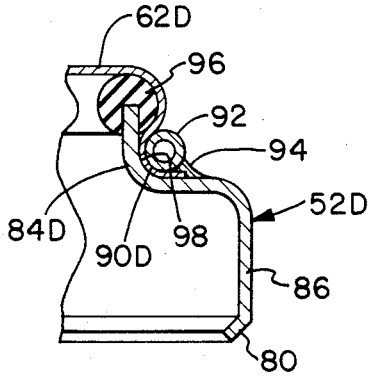
FIG. 8 is an enlarged sectional view of an alternative design of the upper lip on the conductive cup housing of the switch module of FIG. 7.

Alternatively, as seen in FIG. 8, the retaining means rim 84D, rather than being S-shaped, can have a molded ring 96 which defines an annular outwardly-opening groove 98 attached thereto. The annular groove 98 is adapted to receive the peripheral edge portion 90D of the wire mesh patch 62D and seat the spring 92 therein about the wire mesh peripheral edge portion as described hereinabove with respect to the version shown in FIG. 7.

Turning to FIGS. 6 and 7, there is seen the second and third versions of the switch modules generally designated as 12C and 12D respectively. These versions include respective non-conductive plunger members 100 and 102 disposed between and in contact with the corresponding wire mesh patches 62C and 62D and flexible central portions 70 of the sealing members 58. Each of the versions includes a lamp or lamps 104 (either incandescent or LED) mounted on the respective plunger members 100 and 102 and also includes a circuit assembly 106 which electrically connects the lamps to the lamp circuit board 42. Circuit assembly 106 includes third conductive contact terminals 108 and generally C-shaped flexible conductors 110 extending from above to below the sealing member 58 and filler body 60 and between them and the sidewall 86 of the cup-shaped retaining means 52. The flexible conductors 110 at their lower ends, mount to the respective third contact terminals 108 below the filler body 60 and, at their opposite upper end, are electrically connected to the lamp or lamps 104.

Figure 9:
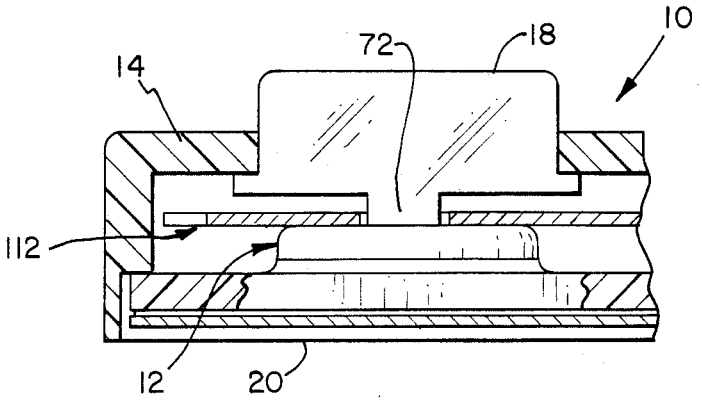
FIG. 9 is a fragmentary view of the push-button keyboard assembly of FIG. 2, showing the presence of an electroluminescent (EL) panel therein.

FIG. 9 illustrates the addition of an electroluminescent (EL) panel 112 to the keyboard assembly 10 between the push-buttons 18 and the switch modules 12 thereof. The electroluminescent panel is energized during times of low ambient light to illuminate the keys or pushbuttons. The EL panel is rather rigid and, therefore, must have clearance holes for the key or pushbutton stems or protuberances 72.

Figure 11:
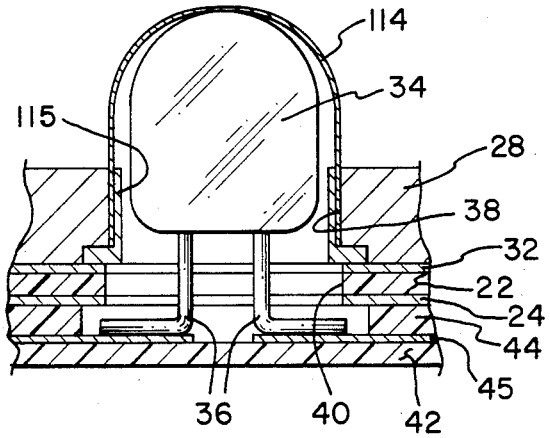
FIG. 11 is an enlarged sectional view of the keyboard assembly of either FIG. 1 or FIG. 10, showing an EMI RFI-shielded light incorporated by the assembly.

In FIGS. 2 and 11, one of the lamps 34 described earlier is illustrated being encompassed by an envelope of EMI and RFI-shielding wire mesh 114 which is connected to panel 28 via L-shaped ring member 115. Wire mesh 114 further prevents EMI and RFI from affecting electrical signals traveling within conductors thereinbelow, and inhibits EMI and RFI from escaping from the keyboard.

Figure 10:
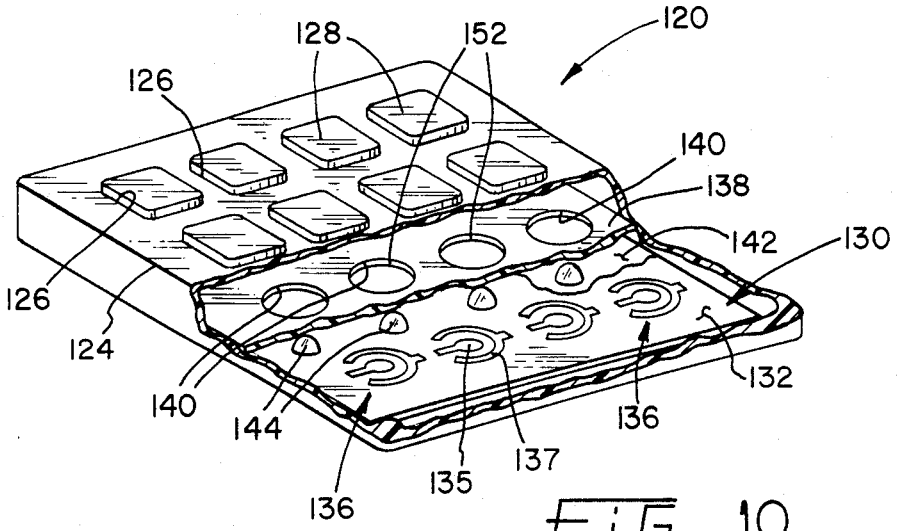
FIG. 10 is a perspective view, with some parts broken away, of a push-button keyboard assembly for employing a plurality of EMI-shielded switch modules constructed in accordance with a second embodiment of the present invention.

Turning now to FIGS. 10 and 12–16, there is shown another EMI and RFI-shielded push-button keyboard assembly, generally designated as 120, incorporating a plurality of EMI RFI-shielded annular ring compressed-type switch modules 122 representing the aforementioned second embodiment thereof. As seen in FIG. 10, the keyboard assembly 120 (similar to the earlier-described keyboard assembly 10) includes a frame 124 having a plurality of key or push-button openings 126, a plurality of keys or push-buttons 128 received in the openings 126, and a printed circuit board 130. The board 130 has a substrate 132 which carries a plurality of different switch sites 136. Switch sites 136 include a flat circular pad or contact terminal 135 partially encompassed by a flat horseshoe-shaped pad or contact terminal 137 both formed on board 130 in a known and customary fashion and both designated as 139 in FIGS. 12–16. The keyboard assembly 120 also includes an electrically-groundable conductive panel 138 overlying the printed circuit board 130 and having a plurality of apertures 140 defined therein in registry with the switch sites 136. A dielectric layer 142 is disposed between the printed circuit board 130 and conductive panel 138 providing electrical isolation therebetween. Lamps 144 (either incandescent or an LED) are incorporated in the keyboard assembly 120 between the underside of the frame 124 and the top of the conductive panel 138. The lamps 144 are electrically connected to a lamp circuit board 141 located below dielectric layer 143 which is mounted on the rear side of the printed circuit board 130, in the same manner as described earlier with respect to lamps 34 of keyboard assembly 10 and shown in FIG. 11. A wire mesh (not shown) also surrounds lamps 144 the same as described earlier with respect to lamps 34 shown in FIG. 11. The push-buttons 128 are composed of translucent plastic material and, thus, the light from the lamps 144 is visible through the push-buttons 128.

As previously mentioned, FIGS. 12–16 illustrate five different versions of the second embodiment of the EMI RFI-shielded switch module 122. In each version of the second embodiment, the switch module 122 includes a conductive contact element 146, sealing means or sealing member 154, non-conductive spacer means or spacer member 150, and annular-shaped conductive retaining means or annular ledge 152. These components, in each version, are identified by the same reference numbers.

The conductive contact element 146 in each version of the second embodiment of the switch module is identical to the contact element 46 in the first embodiment described hereinabove and is preferably a tri-legged element as shown in FIG. 2A. Switch module 122 has a sealing means which includes an annular cap-like sealing member 154 in all five versions. The sealing member 154 is preferably composed of rubber material in all versions which is non-conductive in the first and second versions in FIGS. 12 and 13, respectively, and conductive in the third through fifth versions in FIGS. 14–16. The sealing means also includes a circular-shaped patch of flexible conductive metallic wire mesh 156, only in the first and second versions of FIGS. 12 and 13, respectively, in which the sealing member 154 is non-conductive. In each version, the cap-like sealing member 154 has an annular rim portion 158 being generally rectangular in cross-section which seats upon the circuit board 130. Also, the sealing member 154 has a resilient flexible central portion 160 extending across and integrally connected to the annular rim portion 158. In each version, the sealing member 154 is seated in the aperture 140 of the conductive panel 138, and the dome-shaped contact element 146 is contained within a cavity 166 defined by the annular rim portion 158 of the sealing member 154 below its flexible central portion 160. A depression-producing force is applied to the flexible central portion 160 via the push-button 128 upon depression of the push-button by a user. The flexible central portion 160 of the cap-like sealing member 154 being substantially less in thickness than the annular rim portion 158 thereof is depressible toward the contact element 146 to cause actuation thereof.

Figure 12:
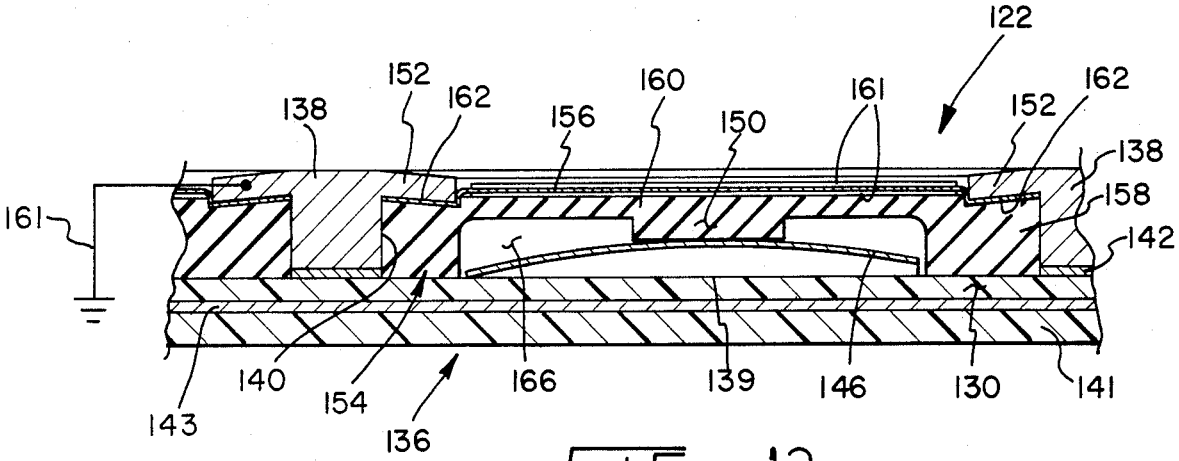
FIG. 12 is an enlarged fragmentary sectional view of the keyboard assembly of FIG. 10, showing one of the EMI RFI-shielded switch modules employed by the keyboard assembly in accordance with a first version of the second embodiment thereof.
Figure 13:
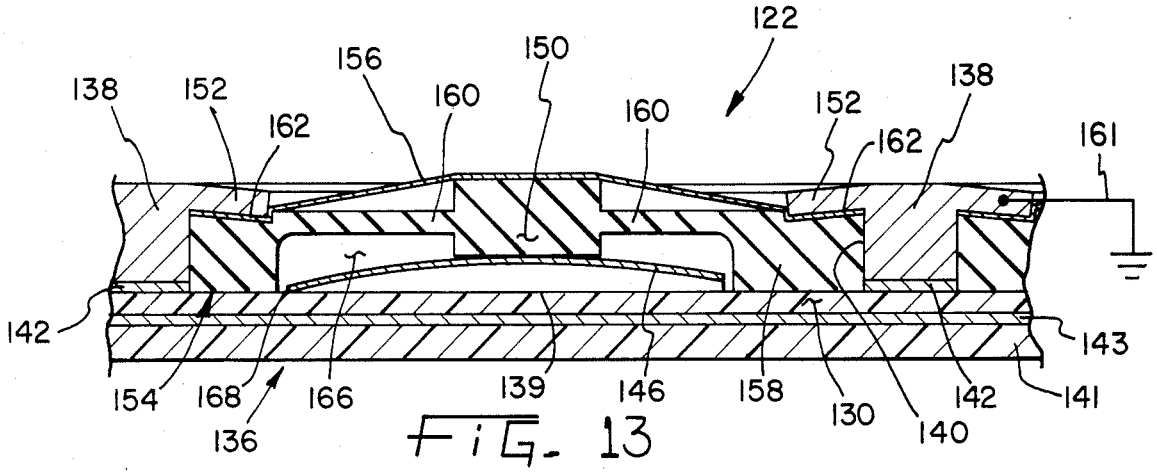
FIG. 13 is a sectional view of an EMI RFI-shielded switch module similar to that of FIG. 12, but illustrating a second version of the second embodiment of the switch module.
Figure 14:
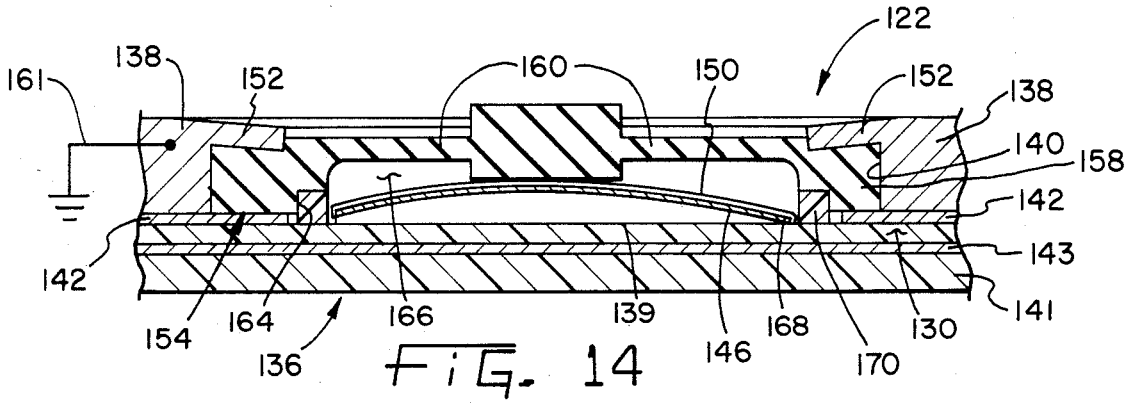
FIG. 14 is a sectional view of an EMI RFI-shielded switch module similar to that of FIG. 12, but illustrating a third version of the second embodiment of the switch module.
Figure 15:
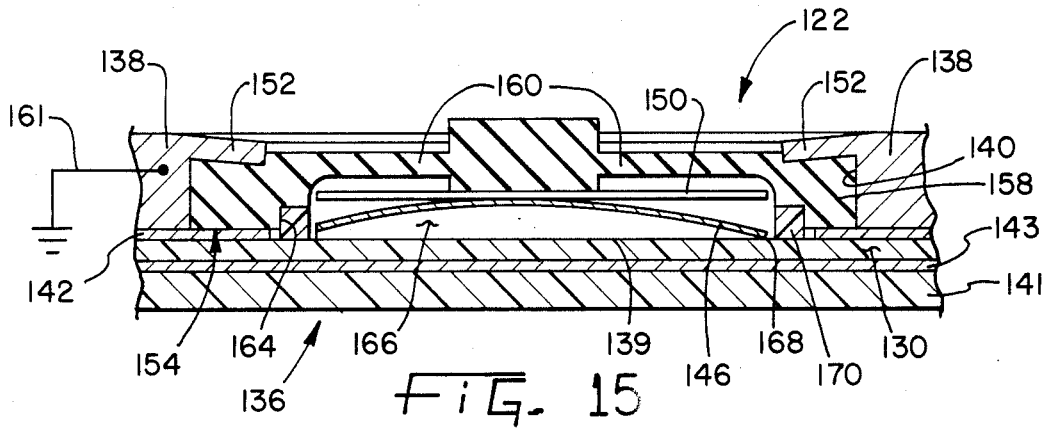
FIG. 15 is a sectional view of an EMI RFI-shielded switch module similar to that of FIG. 12, but illustrating a fourth version of the second embodiment of the switch module; and, FIG. 16 is a sectional view of an EMI RFI-shielded switch module similar to that of FIG. 12, but illustrating a fifth version of the second embodiment of the switch module.
Figure 16:
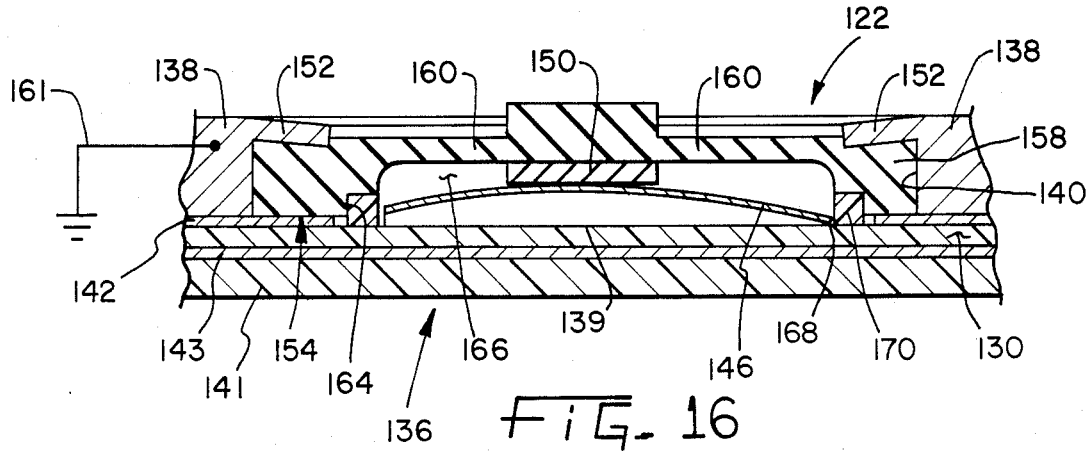

The circular patch of flexible conductive wire mesh 156 in FIGS. 12 and 13 is situated externally of the upper end of the sealing member 154, substantially overlying and covering the annular rim portion 158 and completely overlying flexible central portion 160 of the sealing member 154. In FIG. 12, the wire mesh 156 is covered on both sides or laminated by layers 161 of polyester which does not interfere with the conductive nature of the mesh. The wire mesh 156 provides a conductive shield overlying the contact element 146 and the one switch site 136 and prevents leakage of EMI and RFI either into or out of the keyboard. In the versions of FIGS. 14–16, since the sealing member 154 is conductive, the wire mesh 156 is not used. There, the conductive sealing member 154 acts similarly to the wire mesh 156 and prevents leakage of EMI and RFI.

In all versions of the second switch module embodiment, the retaining means is in the form of an annular ledge 152 which extends from the conductive metallic panel 138 inwardly so as to overlie the periphery of one of the apertures 140 in the panel and one of the switch sites 136. Each annular ledge 152 is coined or crimped downwardly to compress and hold the annular rim portion 158 of the sealing member 154 thereunder. In the first and second versions of FIGS. 12 and 13, respectively, the peripheral edge portions 162 of the wire mesh patches 156 are also clamped, crimped or held under the ledge 152. In such arrangement, the sealing member 154 or wire mesh 156, depending upon which one is conductive, with ledge 152 crimped thereon and the grounded conductive panel 138 via ground path 161 provide an electrical path for blocking EMI and RFI from affecting signals carried by the various circuit paths and from the emission of EMI and RFI from within the keyboard.

A non-conductive spacer means or spacer member 150 of the switch module 122 is used in the versions of FIGS. 14–16. In the versions of FIGS. 12 and 13, it is built-in as a part of the non-conductive sealing members 154. In the version of FIG. 14, the spacer means 150 is a layer of non-conductive material, such as parylene, deposited on the upper face of contact element 146 and along the peripheral edges thereof which face toward the sealing member annular rim portion 158. In the version of FIG. 15, the spacer means 150 is a generally planar disk-shaped shim which overlies and is coextensive with the contact element 146. In the version of FIG. 16, the spacer means 150 is a generally circular block or button made of non-conductive silicon-rubber and molded or attached directly to sealing member central portion 160 which overlies the central portion of the contact element 146.

Finally, in the versions of FIGS. 14–16 wherein the sealing member 154 is conductive, an annular recess 164 is defined in annular rim portion 158 which opens into cavity 166 containing the contact element 146. The recess 164 surrounds the peripheral edge 168 of the contact element 146. A non-conductive annular spacer 170 is received in the recess 164 and, thus, is interposed between the conductive sealing member 154 and the contact element 146 for preventing electrical contact of the contact element 146 with the sealing member rim portion 158.

It should be observed that by heating the solder 88 connecting the sidewall 86 of the cup-shaped conductive retaining means 52 of the first embodiment to the conductive panel 28, the switch modules 12 can be individually removed and replaced. Switch modules 122 of the second embodiment can be individually removed and replaced by disassembling the keyboard assembly and replacing the elements therein from the rear.

It is thought that the EMI RFI-shielded push-button keyboard assemblies of the present invention and many of their attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely preferred or exemplary embodiments thereof.

What is claimed is:

1. An electromagnetic interference and radio frequency interference-shielded switch module comprising:

a body having upper and lower faces;

first and second contact terminals disposed in said body, each of said terminals extending out of said upper and lower faces of said body, said terminals defining respective electrical contact faces on said upper face and respective connecting terminals on said lower face;

a flexible conductive sealing member received over said upper face of said body and defining a cavity therebetween;

a resilient conductive snap-action contact element in said cavity in contact with both of said terminal contact faces when depressed toward said body upper face;

a non-conductive spacer in said cavity between said sealing member and said contact element providing electrical isolation therebetween; and, conductive retaining means surrounding a portion of said body and a portion of said sealing member for holding said body and sealing member together, said retaining means being electrically in contact with said sealing member for conducting electromagnetic interference and radio frequency interference away from said sealing member.

2. The switch module of claim 1 wherein said first and second contact terminals are substantially cylindrically-shaped having said electrical contact face at one axial end thereof and said connecting terminal on the other axial end thereof, said terminals mounted substantially perpendicularly to said upper and lower faces of said cylindrically-shaped body.

3. The switch module of claim 1 wherein said contact element is dome-shaped.

4. The switch module of claim 1 wherein said contact element has a dome-shaped symmetrical tri-legged configuration.

5. The switch module of claim 1 wherein said retaining means includes a cylindrical sidewall, a lower in-turned lip connected to said sidewall at one end thereof, an upper in-turned rim connected to said sidewall at the other end thereof, said sidewall, in-turned lip and in-turned rim laterally surrounding said body and sealing member and holding said body and sealing member together.

6. The switch module of claim 1 wherein said contact face of said first contact terminal is a substantially flat circular pad and said contact face of said second contact terminal is a substantially flat horseshoe-shaped pad partially encompassing said flat circular pad.

7. The switch module of claim 6 wherein said contact element has a dome-shaped symmetrical tri-legged configuration.

8. The switch module of claim 1 further comprising a flexible conductive wire mesh overlying said conductive sealing ember, said conductive retaining means holding said wire mesh over said sealing member and being electrically in contact therewith.

9. The switch module of claim 8 wherein said retaining means includes a cylindrical sidewall interconnected at one end thereof with an in-turned rim, and wherein said wire mesh includes a peripheral edge portion, said peripheral edge portion situated between said in-turned rim and said sealing member thereby holding said wire mesh in place and in electrical contact with said retaining means.

10. The switch module of claim 1 further comprising a light-emitting means situated on said sealing member for emitting light and a wire mesh situated over said light-emitting means, said retaining means holding said wire mesh over said light-emitting means.

11. The switch module of claim 10 wherein said retaining means includes a cylindrical sidewall and an in-turned rim connected to said sidewall at one end thereof, and wherein said wire mesh includes a peripheral edge situated between said in-turned rim and said sealing member thereby electrically connecting said wire mesh to said retaining means and holding said wire mesh over said light-emitting means.

12. The switch module of claim 10 wherein said retaining means includes a cylindrical sidewall and an S-shaped in-turned rim connected to said sidewall at one end thereof, said S-shaped sidewall defining an annular groove, said wire mesh having a peripheral edge received in said groove and wherein a flexible ring member is received in said groove over said peripheral edge of said screen thereby holding said screen over said light-emitting means and in electrical contact with said retaining means.

13. The switch module of claim 12 further comprising electrically conductive adhesive in said annular groove and in contact with said ring member and peripheral edge portion of said wire mesh.

14. The switch module of claim 10 wherein said retaining means includes a cylindrical sidewall and a substantially L-shaped in-turned rim connected to said cylindrical sidewall at one end thereof, further comprising a molded ring connected to said L-shaped in-turned rim and defining an annular outwardly opening groove therewith, said screen having a peripheral edge received in said groove and further comprising a flexible ring member received in said annular groove over said peripheral edge of said screen thereby holding said screen in place over said light-emitting means and in electrical contact with said retaining means.

15. The switch module of claim 14 further comprising electrically conductive adhesive in said annular groove and in contact with said ring member and peripheral edge portion of said wire mesh.

16. An electromagnetic interference and radio frequency interference-shielded switch assembly comprising:

a switch site having a plurality of contact terminals;

a non-conductive sealing member situated over said switch site and defining a cavity over said switch site;

a resilient conductive snap-action contact element in said cavity in contact with a plurality of said terminals when depressed toward said switch site;

a conductive wire mesh situated over said sealing member;

retaining means for holding said wire mesh over said sealing member and holding both said wire mesh and sealing member over said switch site; and a conductive panel having an aperture, said aperture situated in registry with said switch site and wherein said sealing member and contact element are situated within said aperture of said panel and wherein said retaining means is located on said conductive panel.

17. The switch module of claim 16 wherein said retaining means includes an annular ledge on said conductive panel projecting inwardly over said aperture and crimped toward said switch site over said wire mesh and sealing member.

18. The switch module of claim 16 wherein said sealing member includes an annular rim portion and a resilient flexible central portion attached to said annular rim portion thereby creating said cavity.

19. The switch module of claim 16 wherein said wire mesh is laminated between two layers of polyester.

20. The switch module of claim 16 further comprising a frame overlying said panel and having an opening in registry with said panel aperture and sealing member, and a push-button situated in said opening overlying said sealing member thereby transferring a repressive force applied thereon to said sealing member and contact element therebelow.

21. The switch module of claim 20 further comprising a light-emitting means situated between said frame and said grounded panel for emitting light and wherein said button is translucent thereby allowing light emitted by said light-emitting means to travel therethrough.

22. The switch module of claim 21 wherein said grounded panel has a lamp aperture and wherein said light-emitting means is a lamp received in said lamp aperture and further comprising a lamp wire mesh surrounding said lamp and connected to said grounded panel.

23. The switch module of claim 16 further comprising a printed circuitboard, said switch site being on said circuit board, a conductive panel situated over said circuit board having an aperture in registry with said switch site, and a dielectric layer situated between said circuit board and said panel providing electrical isolation therebetween.

24. The switch module of claim 23 wherein said contact terminals include a first substantially flat circular pad terminal and a second substantially flat horseshoe-shaped pad terminal partially encompassing said flat circular pad terminal.

25. The switch module of claim 24 wherein said contact element has a dome-shaped symmetrical tri-legged, configuration.

26. An electromagnetic interference and radio frequency interference-shielded switch assembly comprising:

a switch site having a plurality of contact terminals;

a conductive sealing member situated over said switch site and defining a cavity over said switch site;

a resilient conductive snap-action contact element in said cavity in contact with a plurality of said terminals when depressed toward said switch site;

spacer means in said cavity between said sealing member and said contact element for providing electrical isolation therebetween;

retaining means for holding said wire sealing member over said switch site; and a conductive panel having an aperture, said aperture situated in registry with said switch site and wherein said sealing member and contact element are situated within said aperture of said panel and wherein said retaining means is located on said conductive panel, said conductive panel being electrically connected to said sealing member.

27. The switch module of claim 26 wherein said retaining means includes an annular ledge on said conductive panel projecting inwardly over said aperture and crimped toward said switch site over said sealing member.

28. The switch module of claim 26 wherein said sealing member includes an annular rim portion and a resilient flexible central portion attached to said annular rim portion thereby creating said cavity, an annular recess in said annular rim portion opening into said cavity, and an annular non-conductive spacer received in said annular recess for providing electrical isolation between said contact element and said annular rim portion of said sealing member.

29. The switch module of claim 26 wherein said spacer means includes a non-conductive layer deposited on said contact element.

30. The switch module of claim 26 wherein said spacer means includes a substantially planar disk-shaped non-conductive shim.

31. The switch module of claim 26 wherein said spacer means includes a non-conductive button attached to said sealing member.

32. The switch module of claim 26 further comprising a frame overlying said panel and having an opening in registry with said panel aperture and sealing member, and a pushbutton situated in said opening overlying said sealing member thereby transferring a depressive force applied thereon to said sealing member and contact element therebelow.

33. The switch module of claim 32 further comprising a light-emitting means situated between said frame and said grounded panel for emitting light and wherein said button is translucent thereby allowing light emitted by said light-emitting means to travel therethrough.

34. The switch module of claim 33 wherein said grounded panel has a lamp aperture and wherein said light-emitting means is a lamp received in said lamp aperture and further comprising a lamp wire mesh surrounding said lamp and connected to said grounded panel.

35. The switch module of claim 26 further comprising a printed circuitboard, said switch site being on said circuit board, a conductive panel situated over said circuit board having an aperture in registry with said switch site, and a dielectric layer situated between said circuit board and said panel providing electrical isolation therebetween.

36. The switch module of claim 27 wherein said contact terminals include a first substantially flat circular pad terminal and a second substantially flat horseshoe-shaped pad terminal partially encompassing said flat circular pad terminal.

37. The switch module of claim 36 wherein said contact element has a dome-shaped symmetrical tri-legged configuration.

38. An electromagnetic interference and radio frequency interference-shielded switch module assembly comprising:

a body having upper and lower faces;

first and second contact terminals disposed in said body, each of said terminals extending out of said upper and lower faces of said body, said terminals defining respective electrical contact faces on said upper face and respective connecting terminals on said lower face;

a flexible conductive sealing member received over said upper face of said body and defining a cavity therebetween;

a resilient conductive snap-action contact element in said cavity in contact with both of said terminal contact faces when depressed toward said body upper face;

a non-conductive spacer in said cavity between said sealing member and said contact element providing electrical isolation therebetween;

conductive retaining means surrounding a portion of said body and a portion of said sealing member for holding said body and sealing member together, said retaining means being electrically in contact with said sealing member for conducting electromagnetic interference and radio frequency interference away from said sealing member; and, a grounded conductive panel having an aperture and wherein said retaining means is connected to said grounded panel in said aperture.

39. The switch module assembly of claim 38 wherein said retaining means is electrically connected to said grounded panel with electrically conductive adhesive.

40. The switch module assembly of claim 38 further comprising an outer frame overlying said grounded panel and having an opening and a pushbutton received in said opening and in contact with said sealing member whereby said pushbutton transfers a depressive force to said sealing member.

41. The switch module assembly of claim 40 further comprising a light-emitting means situated between said frame and said grounded panel for emitting light and wherein said button is translucent thereby allowing light emitted by said light-emitting means to travel therethrough.

42. The switch module assembly of claim 41 wherein said grounded panel has a lamp aperture and wherein said light-emitting means is a lamp received in said lamp aperture and further comprising a lamp wire mesh surrounding said lamp and connected to said grounded panel.

* * * * *

UNITED STATES PATENT AND TRADEMARK OFFICE

CERTIFICATE OF CORRECTION

PATENT NO. : 4,814,566

DATED : March 21, 1989

INVENTOR(S) : Edward D. Sigl

It is certified that error appears in the above-identified patent and that said Letters Patent is hereby corrected as shown below:

Column 7, line 49, "5" should read -- 52 --.

Claim 8, line 3, "ember" should read -- member --.

Claim 20, line 5, "repressive" should read -- depressive --.

Signed and Sealed this

Twentieth Day of June, 1989

*Attest:*

DONALD J. QUIGG

*Attesting Officer*

*Commissioner of Patents and Trademarks*